US005952772A

United States Patent [19]

Fox et al.

[11] Patent Number: 5,952,772

[45] Date of Patent: Sep. 14, 1999

[54] DIAMOND ELECTRON EMITTER

[75] Inventors: Neil Anthony Fox, Cheltenham; Wang Nang Wang, Lympley Stoke, both of United Kingdom

[73] Assignee: Smiths Industries Public Limited Company, London, United Kingdom

[21] Appl. No.: 09/010,063

[22] Filed: Jan. 21, 1998

[30] Foreign Application Priority Data

Feb. 5, 1997 [GB] United Kingdom ..... 9702348

[51] Int. Cl.[6] ..... H01J 29/46

[52] U.S. Cl. ..... 313/310; 313/306; 313/631; 313/491; 257/77

[58] Field of Search ..... 313/309, 310, 313/311, 306, 336, 351, 346 R, 495, 496, 631, 633, 491; 257/10, 77

[56] References Cited

U.S. PATENT DOCUMENTS

| | | | |
|---|---|---|---|
| 4,801,994 | 1/1989 | Van Gorkom et al. | 313/346 R |
| 5,202,571 | 4/1993 | Hirabayashi et al. | 257/10 |
| 5,202,605 | 4/1993 | Kaneko et al. | 313/310 |
| 5,410,166 | 4/1995 | Kennel | 257/77 |
| 5,430,348 | 7/1995 | Kane et al. | 313/309 |
| 5,729,094 | 3/1998 | Geis et al. | 313/310 |
| 5,880,481 | 3/1999 | Kroon et al. | 257/10 |

OTHER PUBLICATIONS

Brandes, G.R., et al., "Diamond Junction Cold Cathode," *Diamond and Related Materials*, vol. 4, 1995, pp. 586–590 (no month).

Phetchakul, T., et al., "'Backward Diode' Characteristics of p–Type Diamond/n–Type Silicon Heterojunction Diodes,", *Japanese Journal of Applied Physics*, vol. 35, Part 1, No. 8, Aug. 1996, pp. 4247–4252.

*Primary Examiner*—Michael Day

*Attorney, Agent, or Firm*—Pollock, Vande Sande & Amernick

[57] ABSTRACT

An electron emitter (2) has a semiconductor substrate (20) doped with an n-type region (21). A diamond layer (24) is doped by ion implantation with a p-type dopant to form a graded dopant profile region (27) that increases away from the upper surface of the diamond layer (24) and a thin insulating region (28) separating the p-type region (27) from the n-type region (21). The emitter (2) has a first electrical contact (23) on a lower surface of the substrate (20) and a second electrical contact (25) on the upper surface of the diamond layer (24) such that a voltage can be applied across the emitter (2) to cause tunneling of electrons from the n-type region (21) through the insulating region (28) into the p-type region (27), causing emission of electrons from an exposed surface (29). A lamp or display (1) includes several such electron emitters (2) and contains gas at reduced pressure, which is ionized by the emitted electrons, thereby generating UV radiation, which causes a fluorescent layer (5) on a transparent window (3) to produce visible light.

16 Claims, 1 Drawing Sheet

DIAMOND ELECTRON EMITTER

BACKGROUND OF THE INVENTION

This invention relates to electron emitters and devices.

Electron emitters are used in various devices, such as, for example, cold cathode or other lamps, or in displays. They produce radiation by direct bombardment of a fluorescent layer or by ionisation of a gas, such as in the manner described in GB 2297862.

One form of electron emitter has p-n heterojunction where, for example, the p-type junction is formed by diamond appropriately doped, such as with boron. Examples of electron-emitting diamond junctions are described in U.S. Pat. No. 5,410,166; U.S. Pat. No. 5,202,571; "Diamond Junction Cold Cathode" by Brandes et al., Diamond and Related Materials 4(1995) 586–590; and "Backward Diode Characteristics of p-Type Diamond/n-Type Silicon Heterojunction Diodes" by Phetchakul et al., Jpn J. Appl. Phys. Vol. 35 (1996) pp. 4247–4252. P-n junction emitters are described in "Negative electron affinity devices" by R. L. Bell, Clarendon Press 1973.

BRIEF SUMMARY OF THE INVENTION

It is an object of the present invention to provide an improved diamond electron emitter.

According to one aspect of the present invention there is provided an electron emitter including a semiconductor substrate with an n-type region and a layer of diamond on an upper surface of said substrate, the diamond layer having an exposed region on its upper surface, the diamond layer being doped below said exposed region with a p-type dopant and a graded dopant profile that increases away from the upper surface of the diamond layer, the p-type doped region being spaced from the upper surface of the n-type region to provide an insulating region separating said p-type region from said n-type region, and the emitter having a first electrical contact on the lower surface of said substrate and a second electrical contact on the upper surface of said diamond layer such that a voltage can be applied across the emitter to cause tunnelling of electrons from the n-type region through the insulating region, into the p-type region and emission of electrons from the exposed region.

According to another aspect of the present invention there is provided a electron emitter including a semiconductor substrate, an n-type region within the substrate, a layer of diamond on an upper surface of the substrate, the diamond layer having an exposed region on its upper surface above a p-type doped region, the p-type doped region having a graded dopant profile that increases away from the upper surface of the diamond layer, and the p-type doped region being spaced from an upper surface of the n-type region to provide an insulating region of the diamond layer separating the p-type region from the n-type region, and a voltage source connected across the emitter to cause tunnelling of electrons from the n-type region through the insulating region into the p-type region, causing emission of electrons from the exposed region.

The semiconductor substrate may be of silicon and may be implanted with oxygen outside the n-type region. The n-type region may be doped with a material selected from a group comprising: phosphorus, arsenic and antimony. The semiconductor substrate may be approximately 150 micron thick. The diamond layer is preferably formed by chemical vapour deposition and may be approximately 1–2 micron thick. The p-type doping of the diamond layer is preferably produced by ion implantation, such as with boron ions. The insulating region may be about 0.1 micron thick.

According to a further aspect of the present invention there is provided a device including an electron emitter according to the above one or other aspect of the present invention and containing a gas at reduced pressure that is capable of ionization by electrons emitted from the exposed region.

The gas may include xenon. The device preferably includes a fluorescent layer spaced from the exposed region such that the fluorescent layer is caused to fluoresce by radiation produced by ionization of the gas. The fluorescent layer is preferably provided on a surface of a transparent electrode. The device may be a lamp or display including a plurality of electron emitters.

A lamp including an electron emitter device according to the present invention, will now be described, by way of example, with reference to the accompanying drawing.

DETAILED DESCRIPTION OF THE PREFERRED EMBODIMENT

Figure 1:
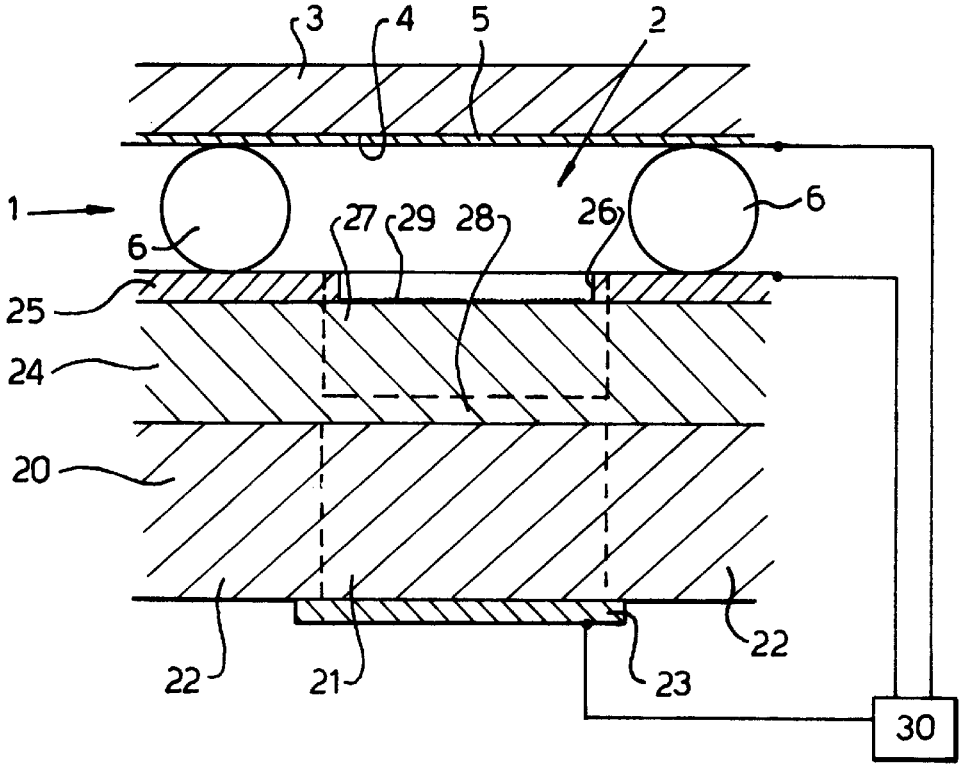
FIG. 1 is a cross-sectional side elevation of the lamp.

With reference to FIG. 1, the lamp comprises an externally-sealed unit 1 containing several electron emitter devices 2, only one of which is shown, and a transparent window 3. The unit 1 is filled with an inert gas such as Xe or a mixture of gases such as Ar—Xe, Ne—Xe, Ne—Ar—Xe at a pressure of between about 250–500 torr. Xe generates intense bursts of radiation of 157 nm (that is, in the VUV range) when excited in a gas discharge. The window 3 has a thin, transparent conductive layer 4 of indium-tin-oxide, forming an anode, on its lower surface and, on top of this, a thin film 5 of a fluorescent phosphor.

The electron emitter 2 has a substrate 20 of a semiconductor, such as silicon, doped to be of n-type in regions 21. The dopant may be, for example, phosphorus, arsenic or antimony. In other regions 22, the silicon is oxygen implanted to improve its insulating properties and maintain the isolation of the n-type regions 21. Typically, the silicon substrate 20 is about 150 $\mu$m thick. On the lower surface of the substrate 20, under the n-type region 21, there is an electrical contact 23 provided by a metal layer, such as of aluminium.

On its upper surface, the substrate 20 has a layer 24 of an insulating diamond material. The layer 24 is preferably formed by the chemical vapour deposition (CVD) process and has a thickness of about 1–2 $\mu$m, or less. An electrical contact 25 in the form of a metal layer, such as of titanium or gold, is deposited on the upper surface of the layer 24. The contact 25 has a central aperture 26, about 2 $\mu$m in diameter, which opens onto the upper surface of the diamond layer 24.

Insulating spacers 6 rest on the contact layer 25 and support the transparent window 3.

The region of the diamond layer 24 beneath the aperture 26 is doped to form a p-type region 27. The width of the p-type region 27 is slightly greater than that of the aperture 26, so that the contact layer 25 overlaps the edge of the p-type region. The doping is carried out by ion implantation (such as using boron ions) at a range of low energies less than about 80 keV. This results in a graded dopant profile having the highest dopant density away from the exposed surface through which the doping is effected. The graded dopant profile is preferred because it facilitates p-diamond energy bands bending down towards the contact 25 on the player, thus ensuring a reduced barrier height for the contact. It may also promote more efficient transport of electrons to the emission surface. Details of graded doping techniques are given in "Graded electron affinity electron source" by Shaw et al., J. Vac. Sci. Technol. B 14(3), May/Jun 1996, pp 2072–2075. The doping is controlled so that the doped region 27 does not extend through the entire depth of the diamond layer 24 but leaves a thin un-doped layer 28, about 0.1 $\mu$m thick, or less, beneath the doped region, between it and the upper surface of the n-type silicon region 21. The pitch of the contacts 25 and the effective size of the aperture of the exposed p-type diamond 27 controls the current density. The exposed upper surface 29 of the doped region 27 is passivated by exposure to an $H_2$ plasma so that the surface exhibits negative electron affinity ($-\chi_e$).

The contacts 23 and 25 and the anode layer 4 are connected to a voltage source 30 outside the unit 1. When no voltage is applied, the un-doped, insulating layer 28 has a low carrier concentration. However, when a dc forward bias is applied across the heterojunction between the silicon and diamond layers 20 and 24, that is, the p-type contact 25 is positive with respect to the n-type contact 23, a significant voltage drop occurs in the layer 28. Because of the small thickness of the layer 28, this results in a steep potential drop across the insulating interface between the n-type silicon region 21 and the p-type diamond region 27.

Figure 2:
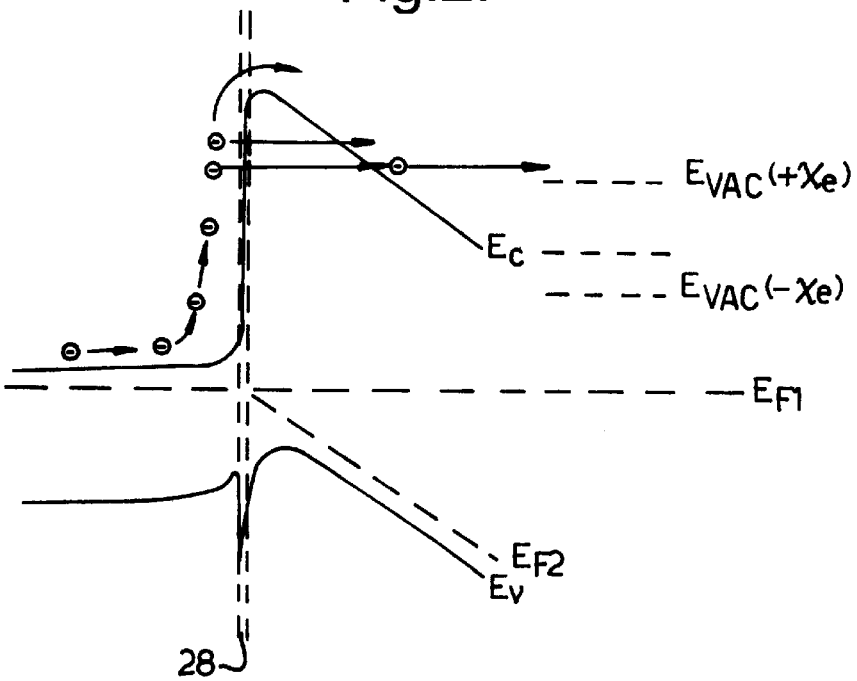
FIG. 2 shows an energy band model of the emitter used in the lamp under forward bias conditions.

FIG. 2 illustrates the conduction energy band $E_c$ and the valence energy band $E_v$ under forward biased conditions. The insulating layer 28 is represented between the two vertical, broken lines in the region of the vertical sections of the conduction bands. The slope to the right of the layer 28 is a result of the graded doping. The conduction band $E_c$ at the surface lies below the vacuum layer $E_{vac}$ that would apply where the diamond has a positive work function ($+\chi_e$). but above that in the present case where the diamond surface has been treated to give it a negative work function ($-\chi_e$). The steep potential enables electrons from the donor levels in the n-type silicon region 21, whose energies lie close to the Fermi level $E_F$, to tunnel more efficiently through the insulating layer 28 across to the conduction band of the p-type diamond 27. The energy of the tunnelling electrons exceeds $E_{vac}$, so the electrons are emitted from the surface 29. The graded doping of the p-type diamond 27 may enable the electron minority carriers injected into the p-type diamond to travel ballistically to the diamond/vacuum interface at the surface 29 with energies higher than would be expected from carriers diffusing through the junction structure and tunnelling into the vacuum/low-pressure gas. The ballistic transport of electrons is described in "Monte Carlo study of hot electron and ballistic transport in diamond: Low electric filed region" by Cutler et al., J. Vac. Sci. Technol. B 14(3), May/Jun 1996 p 2020.

Electrons emitted from the surface 29 and attracted towards the anode layer 4 excite gas in the unit 1 by collision in a weakly ionized plasma. Neutral atoms are then excited by the plasma particles to radiate VUV. The VUV photons impinge on the phosphor layer 5 causing it to fluoresce at visible wavelengths, either in the red, green or blue parts of the spectrum.

It will be appreciated that the electron emitter of the present invention need not be used in lamps but could, for example, be used in displays or other electronic devices.

What we claim is:

1. An electron emitter comprising: a semiconductor substrate; an n-type region within said substrate; and a layer of diamond on an upper surface of said substrate, wherein said diamond layer has an exposed region on its upper surface, wherein said diamond layer is doped below said exposed region with a p-type dopant and a graded dopant profile that increases away from the upper surface of the diamond layer, wherein said p-type doped region is spaced from an upper surface of said n-type region to provide an insulating region separating said p-type region from said n-type region, and wherein said emitter has a first electrical contact on a lower surface of said substrate and a second electrical contact on said upper surface of said diamond layer such that a voltage can be applied across said emitter to cause tunnelling of electrons from said n-type region through said insulating region into said p-type region, causing emission of electrons from said exposed region.

2. An electron emitter according to claim 1, wherein said semiconductor substrate is of silicon.

3. An electron emitter according to claim 1, wherein said semiconductor substrate is implanted with oxygen outside said n-type region.

4. An electron emitter according to claim 1, wherein said n-type region is doped with a material selected from a group comprising: phosphorus, arsenic and antimony.

5. An electron emitter according to claim 1, wherein said semiconductor substrate is approximately 150 micron thick.

6. An electron emitter according to claim 1, wherein said diamond layer is formed by chemical vapour deposition.

7. An electron emitter according to claim 1, wherein said diamond layer is approximately 1–2 micron thick.

8. An electron emitter according to claim 1, wherein said p-type doping of said diamond layer is produced by ion implantation.

9. An electron emitter according to claim 8, wherein said ion implantation is produced with boron ions.

10. An electron emitter according to claim 1, wherein said insulating region is approximately 0.1 micron thick.

11. A device including an electron emitter according to claim 1 and containing a gas at reduced pressure that is capable of ionization by electrons emitted from said exposed region.

12. A device according to claim 11, wherein said gas includes xenon.

13. A device according to claim 11 and including a fluorescent layer spaced from said exposed region such that said fluorescent layer is caused to fluoresce by radiation produced by ionization of said gas.

14. A device according to claim 13 and including a plurality of said electron emitters.

15. An electron emitter comprising: a semiconductor substrate; an n-type region within said substrate; a layer of diamond on an upper surface of said substrate, said diamond layer having an exposed region on its upper surface above a p-type doped region, said p-type doped region having a graded dopant profile that increases away from the upper surface of the diamond layer, and said p-type doped region being spaced from an upper surface of said n-type region to provide an insulating region of said diamond layer separating said p-type region from said n-type region; and a voltage source connected across said emitter to cause tunnelling of electrons from said n-type region through said insulating region into said p-type region, causing emission of electrons from said exposed region.

16. A light-emitting device comprising: a transparent window, said window supporting a fluorescent layer; an electron emitter; and an ionizable gas at reduced pressure between said emitter and said fluorescent layer such that electrons emitted by said emitter cause ionization of said gas and produce radiation, which causes said fluorescent layer to fluoresce at visible wavelengths, and wherein said electron emitter comprises: a semiconductor substrate; an n-type region within said substrate; and a layer of diamond on an upper surface of said substrate, said diamond layer having an exposed region on its upper surface, and a p-type doped region beneath said exposed region, said doped region having a graded dopant profile that increases away from the upper surface of the diamond layer, said p-type doped region being spaced from an upper surface of said n-type region to provide an insulating region separating said p-type region from said n-type region, and said emitter having a first electrical contact on a lower surface of said substrate and a second electrical contact on said upper surface of said diamond layer such that a voltage can be applied across said emitter to cause tunnelling of electrons from said n-type region through said insulating region into said p-type region, causing emission of electrons from said exposed region.

* * * * *